US007707833B1

(12) United States Patent
Bland et al.

(10) Patent No.: US 7,707,833 B1
(45) Date of Patent: May 4, 2010

(54) COMBUSTOR NOZZLE

(75) Inventors: Robert Bland, Oviedo, FL (US); John Battaglioli, Ballston Lake, NY (US)

(73) Assignee: Gas Turbine Efficiency Sweden AB (SE)

( * ) Notice: Subject to any disclaimer, the term of this patent is extended or adjusted under 35 U.S.C. 154(b) by 0 days.

(21) Appl. No.: 12/535,262

(22) Filed: Aug. 4, 2009

Related U.S. Application Data

(63) Continuation of application No. 12/365,539, filed on Feb. 4, 2009.

(51) Int. Cl.
*F02C 1/00* (2006.01)
*F02G 3/00* (2006.01)

(52) U.S. Cl. ..... 60/737; 60/740; 60/746

(58) Field of Classification Search ..... 60/737, 60/734, 739, 740, 742, 746, 747
See application file for complete search history.

(56) References Cited

U.S. PATENT DOCUMENTS

| | | | | |
|---|---|---|---|---|
| 4,292,801 | A | 10/1981 | Wilkes et al. | 60/39.06 |
| 4,949,538 | A | 8/1990 | Iasillo et al. | 60/39.465 |
| 4,982,570 | A | 1/1991 | Waslo et al. | 60/733 |
| 5,054,280 | A | 10/1991 | Ishibashi et al. | 60/39.06 |
| 5,069,029 | A | 12/1991 | Kuroda et al. | 60/39.06 |
| 5,081,843 | A | 1/1992 | Ishibashi et al. | 60/733 |
| 5,127,221 | A | 7/1992 | Beebe | 60/39.02 |
| 5,127,229 | A | 7/1992 | Ishibashi et al. | 60/747 |
| 5,193,346 | A | 3/1993 | Kuwata et al. | 60/737 |
| 5,199,265 | A | 4/1993 | Borkowicz | 60/737 |
| 5,253,478 | A | 10/1993 | Thibault, Jr. et al. | 60/733 |
| 5,259,184 | A | 11/1993 | Borkowicz et al. | 60/39.55 |
| 5,295,352 | A | 3/1994 | Beebe et al. | 60/39.06 |
| 5,450,725 | A * | 9/1995 | Takahara et al. | 60/737 |
| 5,487,275 | A | 1/1996 | Borkowicz et al. | 60/747 |
| 5,491,970 | A | 2/1996 | Davis, Jr. et al. | 60/39.06 |
| 5,575,146 | A | 11/1996 | Borkowicz et al. | 60/39.06 |
| 5,657,631 | A | 8/1997 | Androsov | 60/736 |
| 5,661,969 | A | 9/1997 | Beebe et al. | 60/39.281 |
| 5,685,139 | A * | 11/1997 | Mick et al. | 60/776 |
| 5,778,676 | A | 7/1998 | Joshi et al. | 60/746 |
| 5,862,668 | A | 1/1999 | Richardson | 60/737 |
| 5,873,237 | A * | 2/1999 | Medla et al. | 60/800 |
| 6,038,861 | A | 3/2000 | Amos et al. | 60/737 |
| 6,069,029 | A | 5/2000 | Murakami et al. | 438/123 |
| 6,082,111 | A | 7/2000 | Stokes | 60/737 |

(Continued)

FOREIGN PATENT DOCUMENTS

| | | |
|---|---|---|
| EP | 0564184 | 10/1993 |

*Primary Examiner*—William H Rodríguez
(74) *Attorney, Agent, or Firm*—DLA Piper LLP (US)

(57) ABSTRACT

A secondary nozzle is provided for a gas turbine. The secondary nozzle includes a flange and an elongated nozzle body extending from the flange. At least one premix fuel injector is spaced radially from the nozzle body and extends from the flange generally parallel to the nozzle body. At least one second nozzle tube is fluidly connected to the fuel source and spaced radially outward from the first nozzle tube with a proximal end fixed to the flange. The second nozzle tube has a distal end, spaced from the proximal end, with at least one aperture therein. A passageway extends between the proximal end and the distal end of the second nozzle tube, with the passageway fluidly connecting to the fuel source and the aperture.

16 Claims, 11 Drawing Sheets

U.S. PATENT DOCUMENTS 6,109,038 A 8/2000 Sharifi et al. ..... 60/737
6,161,387 A 12/2000 Green ..... 60/748
6,199,368 B1 * 3/2001 Onoda et al. ..... 60/39.463
6,282,904 B1 9/2001 Kraft et al. ..... 60/739
6,374,594 B1 4/2002 Kraft et al. ..... 60/39.37
6,405,523 B1 6/2002 Foust et al. ..... 60/39.06
6,427,446 B1 8/2002 Kraft et al. ..... 60/737
6,438,961 B2 8/2002 Tuthill et al. ..... 60/776
6,446,438 B1 9/2002 Kraft et al. ..... 60/737
6,446,439 B1 9/2002 Kraft et al. ..... 60/739
6,453,658 B1 9/2002 Willis et al. ..... 60/39.36
6,467,272 B1 10/2002 Biondo et al. ..... 60/740
6,474,071 B1 11/2002 Durbin et al. ..... 60/748
6,598,383 B1 * 7/2003 Vandervort et al. ..... 60/773
6,675,581 B1 * 1/2004 Stuttaford et al. ..... 60/737
6,691,515 B2 2/2004 Verdouw et al. ..... 60/737
6,691,516 B2 * 2/2004 Stuttaford et al. ..... 60/737
6,722,132 B2 * 4/2004 Stuttaford et al. ..... 60/737
6,761,033 B2 7/2004 Inoue et al. ..... 60/776
6,786,047 B2 9/2004 Bland et al. ..... 60/737
6,813,890 B2 11/2004 Martling et al. ..... 60/737
6,837,052 B2 1/2005 Martling ..... 60/737
6,857,271 B2 2/2005 Kraft et al. ..... 60/737
6,874,323 B2 4/2005 Stuttaford ..... 60/776
6,886,346 B2 * 5/2005 Sobieski et al. ..... 60/776
6,898,937 B2 * 5/2005 Stuttaford et al. ..... 60/737
6,915,636 B2 7/2005 Stuttaford et al. ..... 60/737
6,945,053 B2 9/2005 Von Der Bank ..... 60/776
6,993,916 B2 * 2/2006 Johnson et al. ..... 60/776
6,996,991 B2 2/2006 Gadde et al. ..... 60/776
7,024,861 B2 4/2006 Martling ..... 60/737
7,143,583 B2 12/2006 Hayashi et al. ..... 60/776
7,165,405 B2 * 1/2007 Stuttaford et al. ..... 60/737
7,171,813 B2 2/2007 Tanaka et al. ..... 60/737
7,197,877 B2 * 4/2007 Moraes ..... 60/740
7,266,945 B2 9/2007 Sanders ..... 60/743
7,360,363 B2 4/2008 Mandai et al. ..... 60/737
7,370,478 B2 5/2008 Rocca ..... 60/776
7,412,833 B2 8/2008 Widener ..... 60/772
7,426,833 B2 * 9/2008 Yoshida et al. ..... 60/737
7,464,553 B2 12/2008 Hsieh et al. ..... 60/748
7,469,543 B2 * 12/2008 Veninger ..... 60/723
7,536,862 B2 5/2009 Held et al. ..... 60/742
7,540,153 B2 * 6/2009 Tanimura et al. ..... 60/737
7,546,735 B2 * 6/2009 Widener ..... 60/746
7,547,002 B2 6/2009 Mao et al. ..... 261/78.1
7,673,455 B2 * 3/2010 Yoshida et al. ..... 60/737
2004/0006989 A1 * 1/2004 Stuttaford et al. ..... 60/776
2004/0006992 A1 * 1/2004 Stuttaford et al. ..... 60/776
2004/0144098 A1 7/2004 Willis et al. ..... 60/776
2005/0034457 A1 * 2/2005 Gadde et al. ..... 60/737
2006/0026966 A1 * 2/2006 Moraes ..... 60/796
2006/0168966 A1 8/2006 Stuttaford et al. ..... 60/772
2007/0028618 A1 2/2007 Hsiao et al. ..... 60/737
2007/0074517 A1 4/2007 Rogers et al. ..... 60/776
2007/0074518 A1 4/2007 Rogers et al. ..... 60/776
2007/0119177 A1 5/2007 McMasters et al. ..... 60/737
2007/0130955 A1 6/2007 Vandale et al. ..... 60/776
2007/0131796 A1 6/2007 Hessler ..... 239/424
2007/0151255 A1 7/2007 Johnson et al. ..... 60/776
2007/0175219 A1 8/2007 Cornwell et al. ..... 60/737
2007/0207425 A1 9/2007 Brautsch et al. ..... 431/159
2007/0220898 A1 9/2007 Hessler ..... 60/776
2007/0234735 A1 10/2007 Mosbacher et al. ..... 60/780
2007/0289305 A1 12/2007 Oda et al. ..... 60/748
2008/0078182 A1 4/2008 Evulet ..... 60/776
2008/0078183 A1 4/2008 Ziminsky et al. ..... 60/776
2008/0083229 A1 4/2008 Haynes et al. ..... 60/776
2008/0098736 A1 5/2008 Lee et al. ..... 60/734
2008/0148736 A1 6/2008 Ishizaka et al. ..... 60/737
2009/0019855 A1 1/2009 Venkataraman et al. ..... 60/738
2009/0077972 A1 3/2009 Singh ..... 60/737
2009/0145983 A1 6/2009 Stuttaford et al. ..... 239/533.2

* cited by examiner

COMBUSTOR NOZZLE

CROSS REFERENCE TO RELATED APPLICATION

This application is a continuation of U.S. application Ser. No. 12/365,539, filed Feb. 4, 2009.

TECHNICAL FIELD

The present invention relates to combustors that may be used in combustion turbines. More specifically, the present invention relates to a nozzle system for injecting fuel into a combustor.

BACKGROUND

Gas turbines play a predominant role in a number of applications, namely in aircraft propulsion, marine, propulsion, power generation and driving processes, such as pumps and compressors. Typically, a gas turbine includes a compressor, a combustor and a turbine. In operation, air is fed into the system where it is compressed by a compressor and a portion of the air further mixed with fuel. The compressed air and fuel mixture are then burned to cause an expansion, which is responsible for driving the turbine.

In an effort to reduce emissions, combustors have been designed to premix fuel and air prior to ignition. Premixed fuel and air burn at a lower temperature than the stoichiometric combustion, which occurs during traditional diffusion combustion. As a result, premixed combustion results in lower NOx emissions.

A typical combustor includes a plurality of primary fuel nozzles that surround a central secondary nozzle. Traditional secondary nozzles may include passageways for diffusion fuel and premix fuel all within the same elongated tubular structure. This type of nozzle often includes a complex structure of passageways contained within a single tubular shell. The passageways for creating the diffusion flame extend through the length of the nozzle. Premix fuel is dispensed upstream of the diffusion tip in order to allow fuel to mix with compressed air flowing through the combustor prior to reaching the flame zone, which is located downstream of the nozzle. As a result, passageways for premix fuel are typically shorter than passageways for diffusion fuel.

Additionally, premix fuel may be mixed with air upstream of the diffusion tip and, more importantly, radially outward of the secondary nozzle structure. In this type of secondary nozzle, premix fuel is carried along only a portion of the nozzle length until it is passed radially outward from the nozzle body to a premix injector tip. At the injector tip, the premix fuel is dispensed into the air flow path. As the fuel and air continue to travel downstream along the remainder of the secondary nozzle length, they become mixed, allowing for more efficient combustion within the flame zone, downstream of the nozzle tip.

While compressed air is hot, fuel is typically cool in comparison. The temperature differentials flowing through the different passageways in the secondary nozzle may result in different levels of thermal expansion of the materials used to construct the nozzle. It is contemplated that it would be beneficial to simplify the secondary nozzles to reduce the high stresses on the nozzle structures resulting from their internal complexity, extreme operating conditions and thermal expansion differentials.

SUMMARY OF THE INVENTION

Provided is a secondary nozzle for inclusion within a combustor for a combustion turbine. The secondary nozzle comprises a flange and an elongated nozzle body extending from the flange. At least one premix fuel injector is spaced radially from the nozzle body and extends axially from the flange, generally parallel to the nozzle body.

The secondary nozzle comprises a fuel source, a flange and a first nozzle tube extending axially from the flange. At least one second nozzle tube is spaced radially outward from the first nozzle tube and has a proximal end fixed to the flange. The second nozzle tube is fluidly connected to the fuel source. The second nozzle tube has a distal end, axially spaced from the proximal end of the second nozzle and having at least one aperture therein. A passageway extends between the proximal end of the second nozzle tube and the distal end of the second nozzle tube, said passageway fluidly connects the fuel source and the at least one aperture.

DETAILED DESCRIPTION

Described herein is an exemplary combustor for use in a combustion turbine. The combustor of the type illustrated is one of a plurality of combustors, typically positioned after the compressor stage within the combustion turbine.

Figure 1:
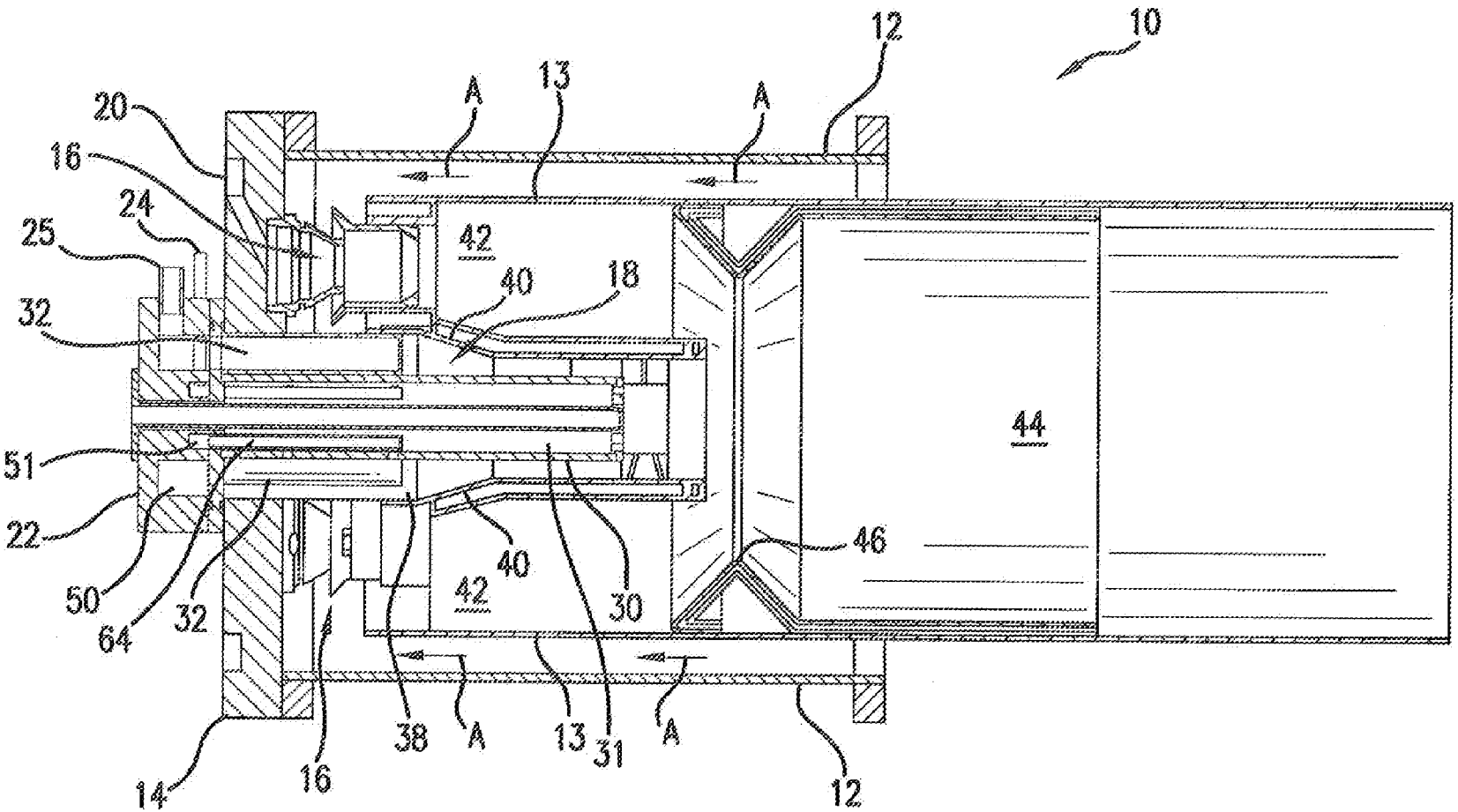
FIG. 1 is a cross sectional view of an exemplary combustor for a combustion turbine having a plurality of primary nozzles and a secondary nozzle therein.

Referring now to the figures and initially to FIG. 1, the combustor is designated by the numeral 10 and as illustrated is a dual stage, dual mode combustor having a combustor flow sleeve 12, a rear wall assembly 14 and a combustor wall 13. Radially inward of the combustor wall 13 are provided a plurality of primary fuel nozzles 16 and a secondary fuel nozzle 18. The nozzles 16, 18 serve to inject fuel into the combustor 10.

Inlet air for combustion (as well as cooling) is pressurized by the turbine compressor (not shown) and then directed into the combustor 10 via the combustor flow sleeve 12 and a transition duct (not shown). Air flow into the combustor 10 is used for both combustion and to cool the combustor 10. The air flows in the direction "A" between the combustor flow sleeve 12 and the combustor wall 13. Generally, the airflow illustrated is referred to as reverse flow because the direction "A" is in an upstream direction to the normal flow of air through the turbine and the combustion chambers.

Figure 2:
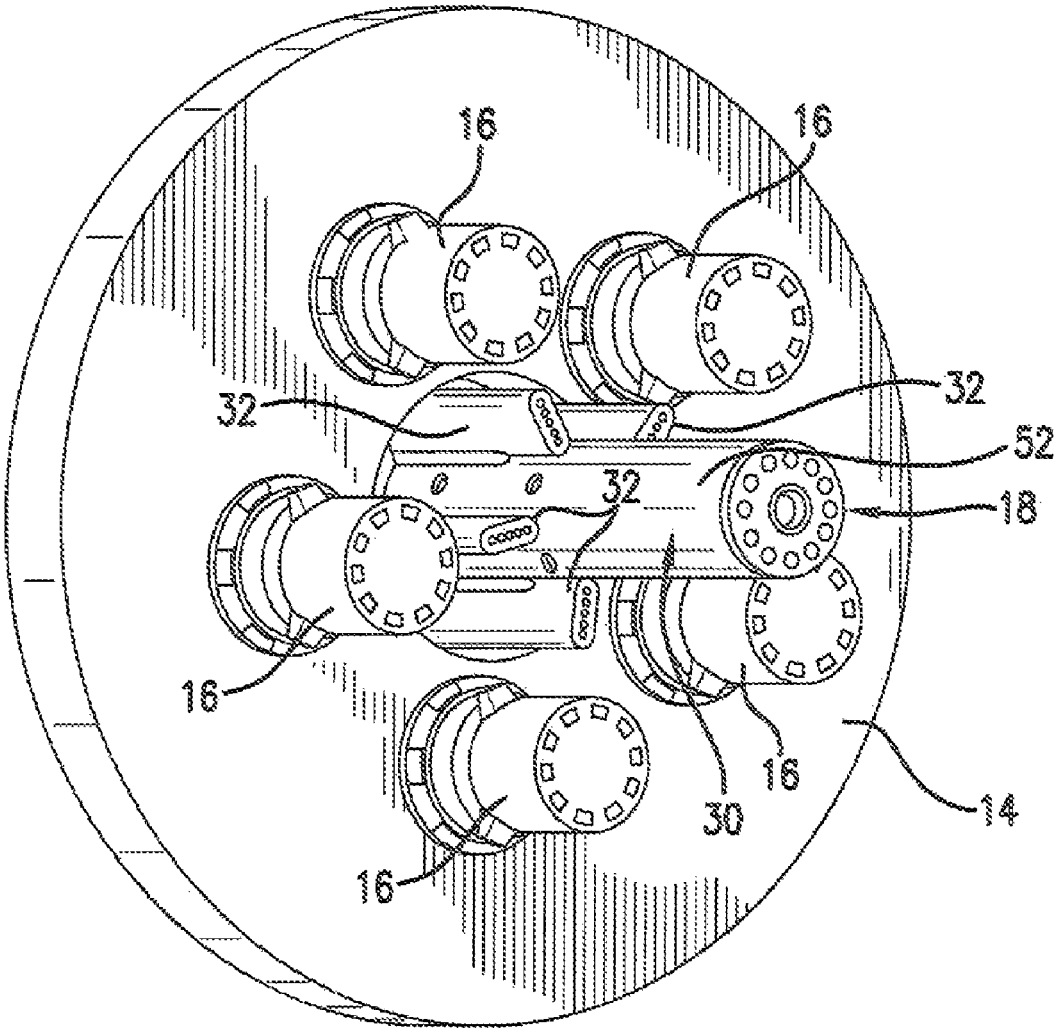
FIG. 2 is a perspective view of exemplary primary nozzles and a secondary nozzle.
Figure 3:
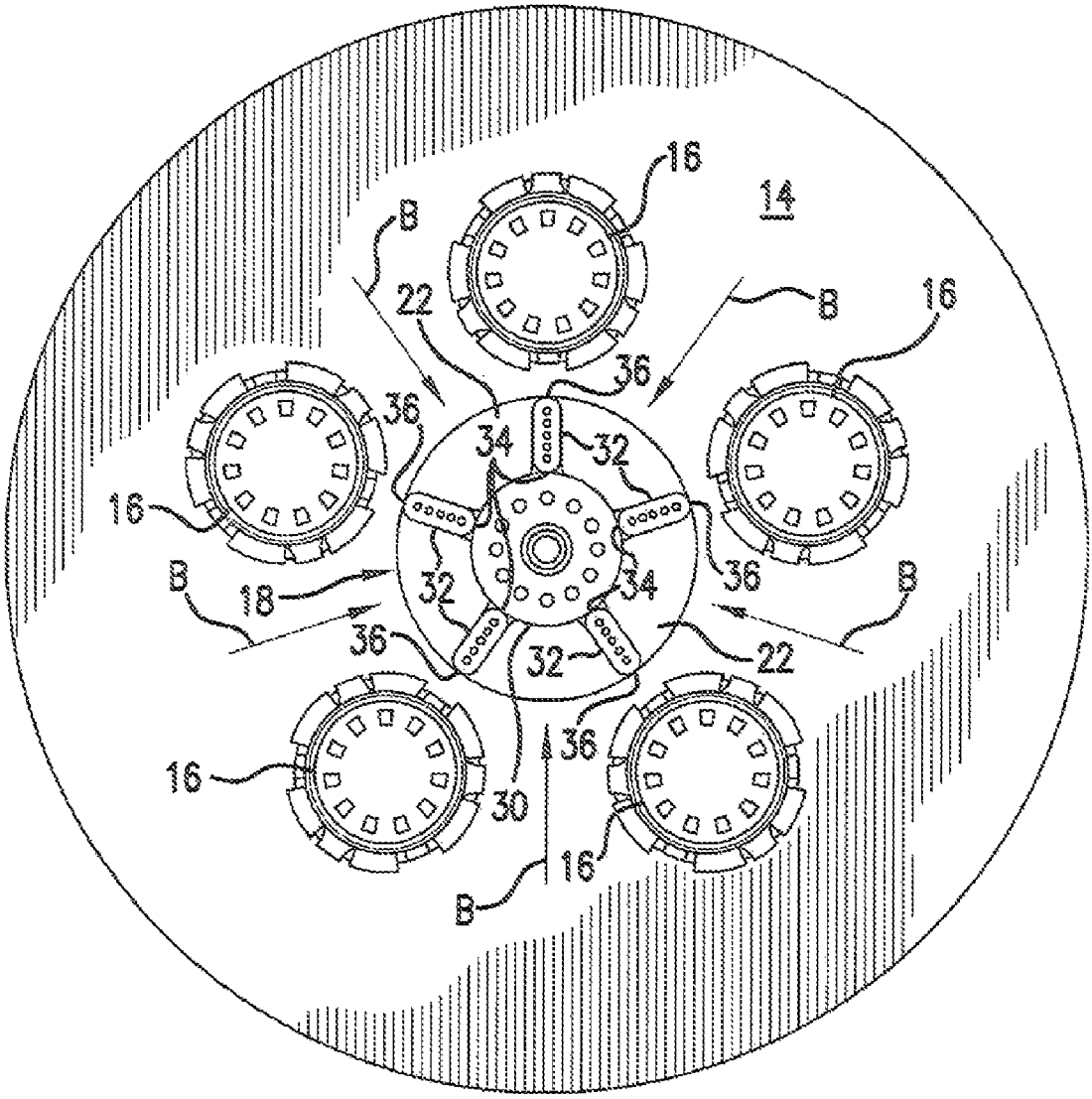
FIG. 3 is a front elevational view of a plurality of primary nozzles and a secondary nozzle as shown in FIGS. 1 and 2.
Figure 4:
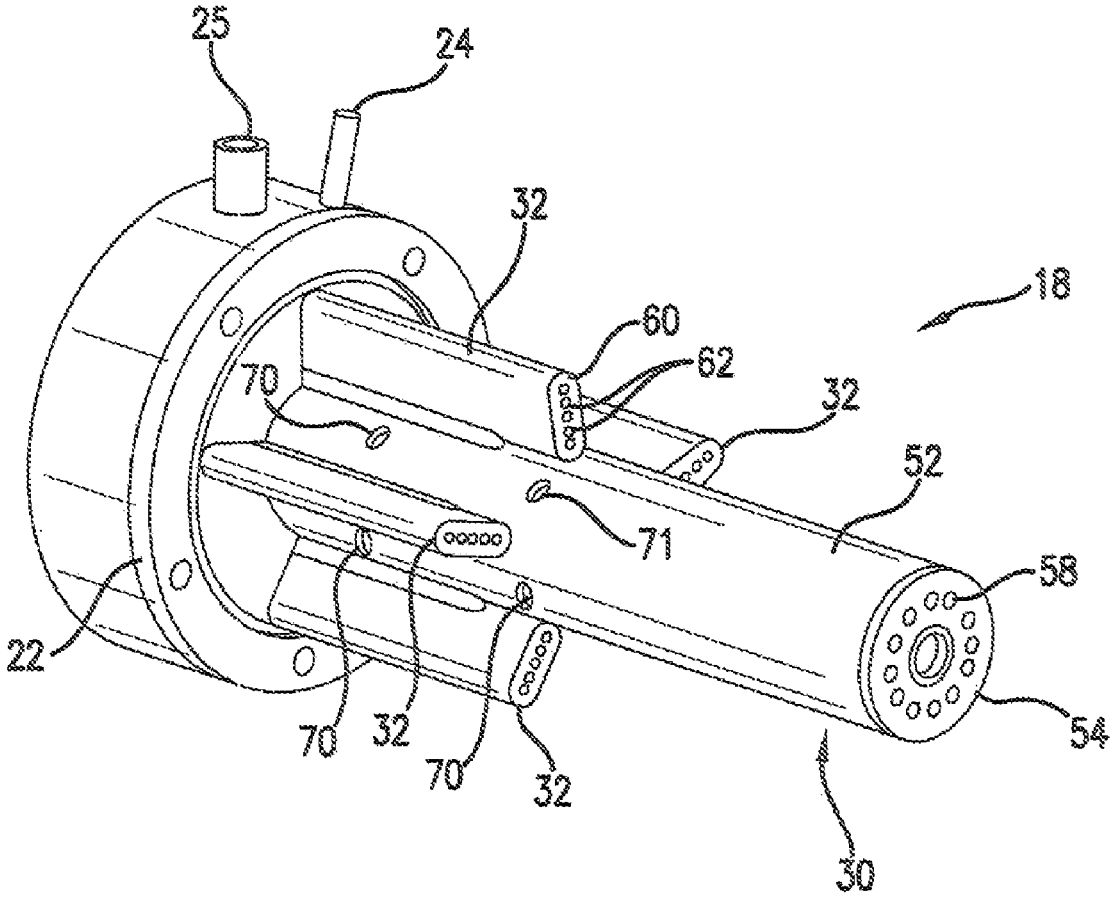
FIG. 4 is a perspective view of a secondary nozzle as shown in FIGS. 1-3.

The combustor 10 includes a primary combustion chamber 42 and a secondary combustion chamber 44, located downstream of the primary combustion chamber 42. A venturi throat region 46 is located between the primary and secondary combustion chambers 42, 44. As shown in FIGS. 2 and 3, the primary nozzles 16 are arranged in an annular ring around the secondary nozzle 18. In FIG. 1, a centerbody 38 is defined by a liner 40 in the center of the combustor 10.

Referring now to FIGS. 1-3, each of the primary nozzles 16 are mounted on a rear wall assembly 14. The primary nozzles 16 protrude from the rear wall 14 and provide fuel to the primary combustion chamber 42. Fuel is delivered to the primary nozzles 16 via a primary fuel source 20. Spark or flame for combustion ignition in the primary combustion chamber 42 is typically provided by spark plugs or cross fire tubes (not shown).

Air swirlers may be provided in connection with the primary nozzles 16 to facilitate mixing of combustion air with fuel to provide an ignitable mixture of fuel and air. As mentioned above, combustion air is derived from the compressor and routed in the direction "A," between the combustor flow sleeve 12 and the combustor wall 13. Upon reaching the rear wall assembly 14, the pressurized air flows radially inward between the combustor wall 13 and the rear wall 14 into the primary combustion chamber 42. Additionally, the combustor wall 13 may be provided with slots or louvers (not shown) in both the primary and secondary combustion chambers 42, 44 for cooling purposes. The slots or louvers may also provide dilution air into the combustor 10 to moderate flame temperature within the primary or secondary combustion chambers 42, 44.

Referring now to FIGS. 1-4, the secondary nozzle 18 extends from a flange 22 into the combustor 10 through the rear wall 14. The secondary nozzle 18 extends to a point upstream of the venturi throat region 46 to introduce fuel into the secondary combustion chamber 44. The flange 22 may be provided with means for mounting (not shown) the secondary nozzle 18 on the rear wall 14 of the combustor 10. The mounting means may be a mechanical linkage, such as bolts, which serve to fix the flange 22 to the rear wall 14 and which facilitate the removal of the nozzle 18, such as for repairs or replacement. Other means for attachment are also contemplated.

Fuel for the primary nozzles 16 is supplied by a primary fuel source 20 and is directed through the rear wall 14. Secondary transfer and premix fuel sources 24, 25 are provided through the flange 22 to the secondary nozzle 18. Although not shown here, the secondary nozzle 18 may also have a diffusion circuit or pilot circuit for injecting fuel into the combustor 10.

The secondary nozzle 18 comprises a nozzle body 30 and at least one premix fuel injector 32. The secondary nozzle 18 is located within the centerbody 38 and is surrounded by the liner 40, as shown in FIG. 1. The premix fuel injectors 32 are arranged on the flange 22 in a generally annular configuration, around the nozzle body 30, as best seen in FIG. 3. Each of the premix fuel injectors 32 has a generally oblong or elongated cross-sectional shape when viewed from the top. As best seen in FIG. 3, a first side or end 34 of the injectors 32 is disposed proximate the nozzle body 30. A second side or end 36 of the injectors 32 is disposed radially outward of the first end 34.

The premix fuel injectors 32 are shown aligned directly between the primary nozzles 16 and the nozzle body 30 to facilitate airflow through the centerbody 38 and around the nozzle body 30. In such an arrangement, the second ends 36 of the premix fuel injectors 32 are disposed proximate the primary nozzles 16. Air flow "A" into the combustor 10 travels radially inward from outside of the combustor wall 13. A portion of this air travels downstream, into and through the primary combustion chamber 42. Another portion of the air, by way of example 5 to 20% of the total air flow through the combustor, travels radially inward past the primary nozzles 16 and the primary combustion chamber 42 into the centerbody 38 before travelling downstream through the centerbody. The direction of this second portion of airflow along the flange 22 and rear wall 14 is denoted by the letter "B" in FIG. 3. While other configurations may be used, aligning the premix fuel injectors 32 radially inward of the primary nozzles 16, between the primary nozzles 16 and the secondary nozzle 18, allows for maximum airflow into the centerbody 38. Likewise, while premix fuel injectors 32 shown have an elongated cross section, other shapes may also be used, such as round, rectangular, triangular, etc.

Figure 5:
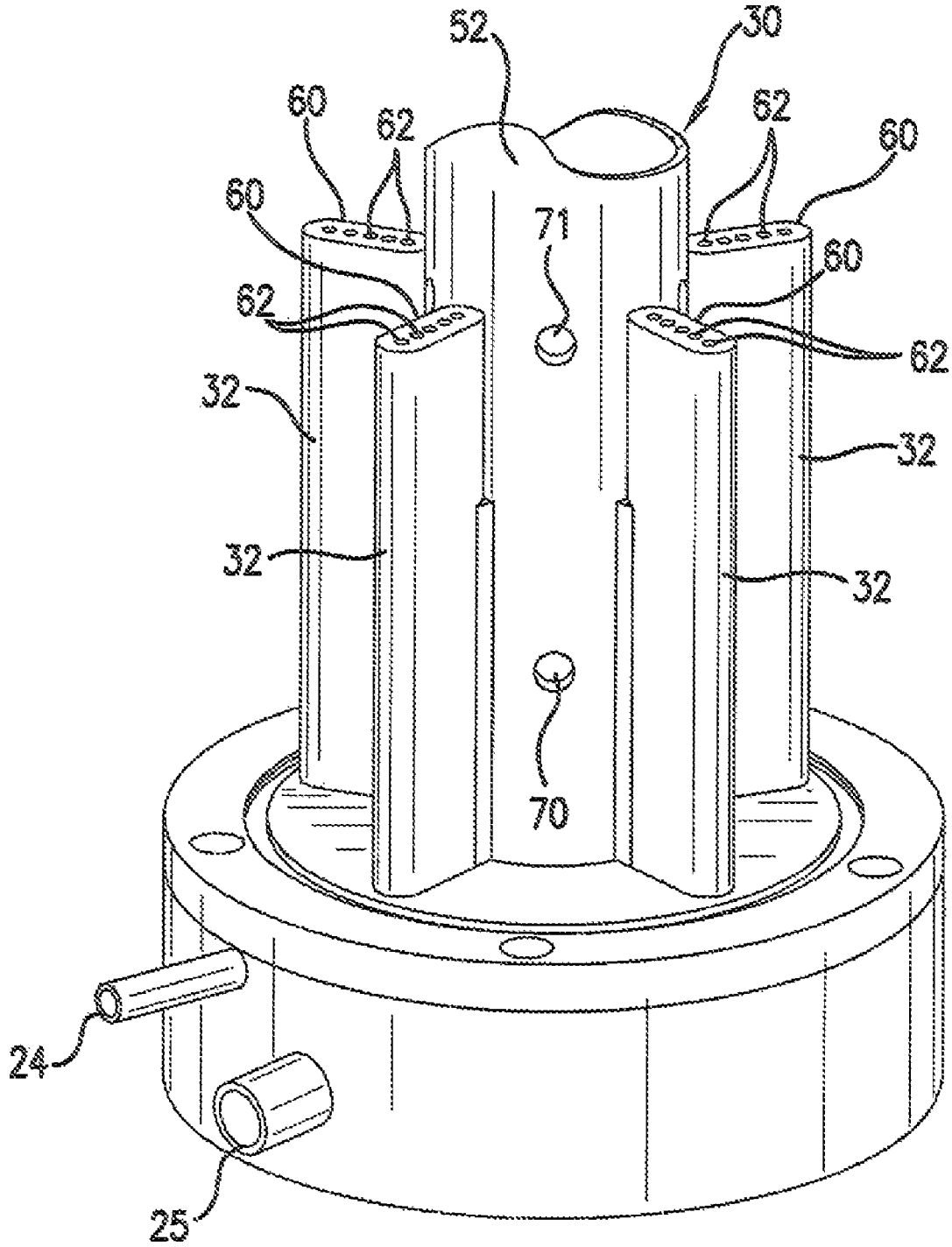
FIG. 5 is a partial perspective view of the secondary nozzle of FIGS. 1-4.
Figure 6:
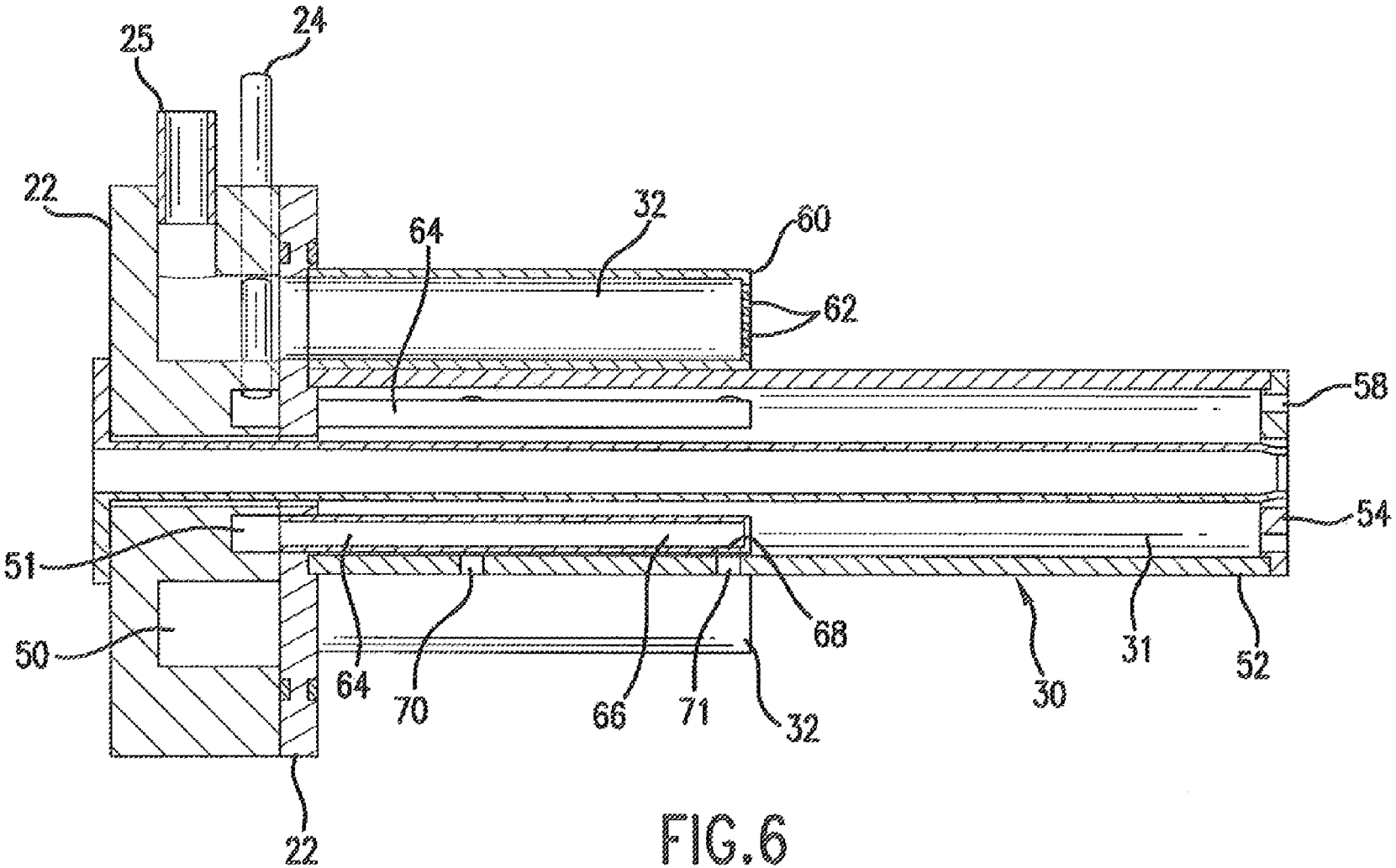
FIG. 6 is a cross sectional view of the secondary nozzle of FIGS. 1-5.
Figure 7:
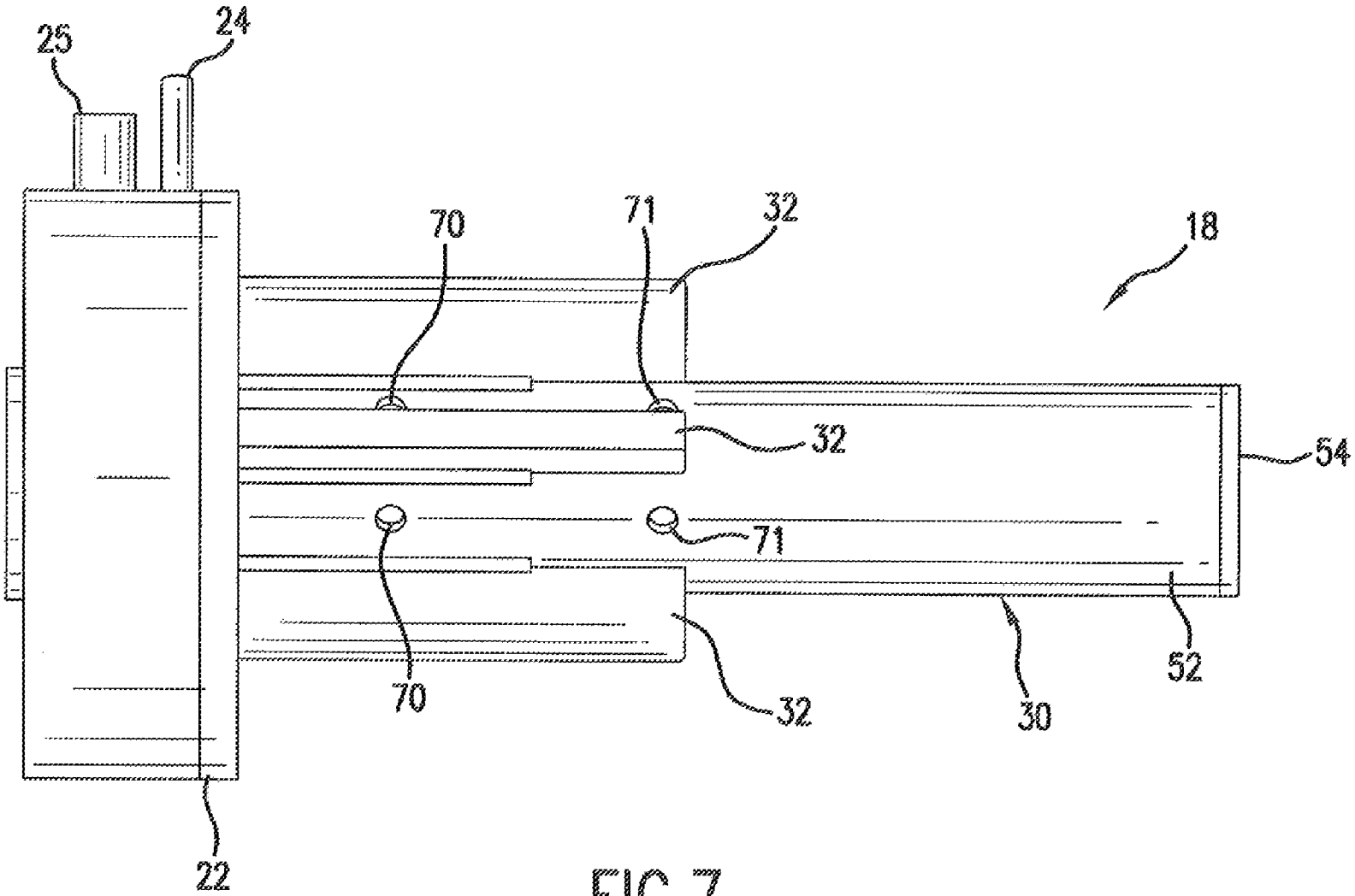
FIG. 7 is a schematic view of a portion of the secondary nozzle of FIGS. 1-6.

Referring now to FIGS. 5-7 and with continued reference to FIGS. 1-4, the secondary nozzle 18 is shown including a nozzle body 30 and premix fuel injectors 32. As described above, the secondary nozzle 18 is located in the centerbody 38 and surrounded by the liner 40 (FIG. 1). The nozzle body 30 extends along the longitudinal axis of the centerbody 38. The nozzle body 30 has a generally elongated cylindrical outer sleeve portion 52 which defines a cavity 31 therein. As shown, transfer fuel passages 64 are located within the outer portion of cavity 31. The transfer fuel passages 64 extend distally from the flange 22 and are arranged at spaced locations in an annular configuration. Transferless variants are known and may also be utilized.

The transfer fuel passages 64 are fluidly connected to the transfer manifold 51, which is fed by the transfer fuel source 24. The transfer fuel passages 64 include a longitudinal tube 66 and at least one radial passageway 68. The passageway 68 is directed radially outward from the tube 66 and is aligned with an aperture 71 in the wall of the nozzle body 30. The passageway 68 jets the fuel through the opening 71 to the outside of the sleeve 52 to mix with the air flowing along the wall 52. A second opening 70 is shown upstream of opening 71 and provides an inlet for air into the portion of the cavity 31 surrounding the central tube positioned within the nozzle body 30. A portion of the air moving past the opening 70 is directed into the cavity 31 to cool the nozzle body 30. The air in the cavity 31 is exhausted from the openings 58 on the end 54 of the nozzle. The central tube feeds fuel to the nozzle end 54 for supporting a flame in the secondary combustion chamber 44. (See FIG. 1 and FIGS. 9-11.) The openings 70 are separated from the fuel provided by passageway 68 and the additional fuel provided by injectors 32. It is noted that additional openings may be provided to mix the flow of fuel outside the nozzle body 30 or to direct the flow of air into the nozzle cavity 31. Also, the fuel passages 64 may be eliminated if desired.

The outer sleeve portion 52 of the nozzle body 30 extends from the flange 22 to a distal tip 54. The tip 54 of the nozzle body 30 has at least one aperture 58 for allowing the passage of pressurized air from inside of the passageway 31 that surrounds the central tube portion.

As mentioned above, fuel is supplied to the secondary nozzle 18 through the transfer fuel source 24 and the premix fuel source 25. As seen best in FIG. 6, the transfer fuel source 24 extends into the flange 22, providing fuel to the transfer manifold 51, which is fluidly connected to the transfer fuel passages 64. The premix fuel source 25 extends into the flange 22 and is in fluid communication with premix manifold chamber 50, which is fluidly connected to the premix fuel injectors 32.

The premix fuel injectors 32 extend distally from the flange 22 having a length that is less than that of the nozzle body 30. A distal end 60 of the premix fuel injectors 32 includes premix apertures 62 for dispensing fuel into the area of the centerbody 38 outside of the nozzle body 30. The premix fuel is mixed with air flowing within the liner 40. When the mixture reaches the secondary combustion chamber 44, the mixture is optimized for efficient combustion in the secondary combustion chamber 44 (see FIG. 1).

Unlike typical secondary nozzles, where diffusion and premix fuel is discharged through a single structure extending from a flange, use of a stand alone premix fuel injector 32 allows for a simplification of the nozzle body 30. The injectors 32 shown allow for less internal passageways inside the nozzle body 30 than the typical nozzles. This simplification reduces the stress on the secondary nozzle 18 that may arise from heat differentials within the nozzle structures 18, 32 due to the variation in temperature of the fuel and the pressurized air. Additionally, the contemplated design is easier to maintain and allows for a degree of modularity not possible with traditional secondary nozzles.

In addition to the structures shown, the premix fuel injectors 32 may have a dispensing ring fluidly connected to one or more sets of the premix apertures 62. Other dispenser tip structures may also be used with the premix fuel injectors 32 of the type particularly shown.

Figure 8:
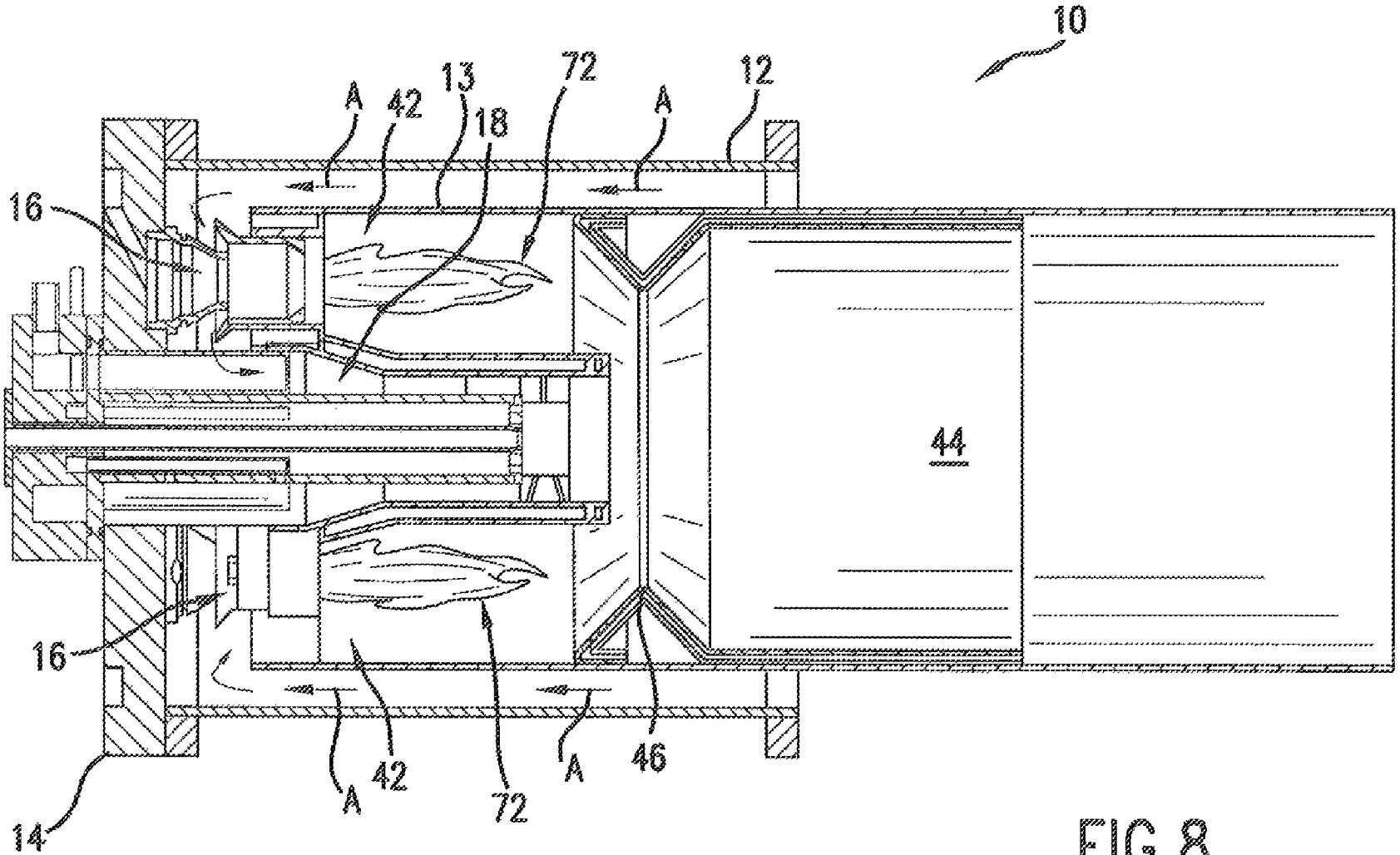
FIG. 8 is a schematic view of the primary operation of an exemplary combustor.
Figure 9:
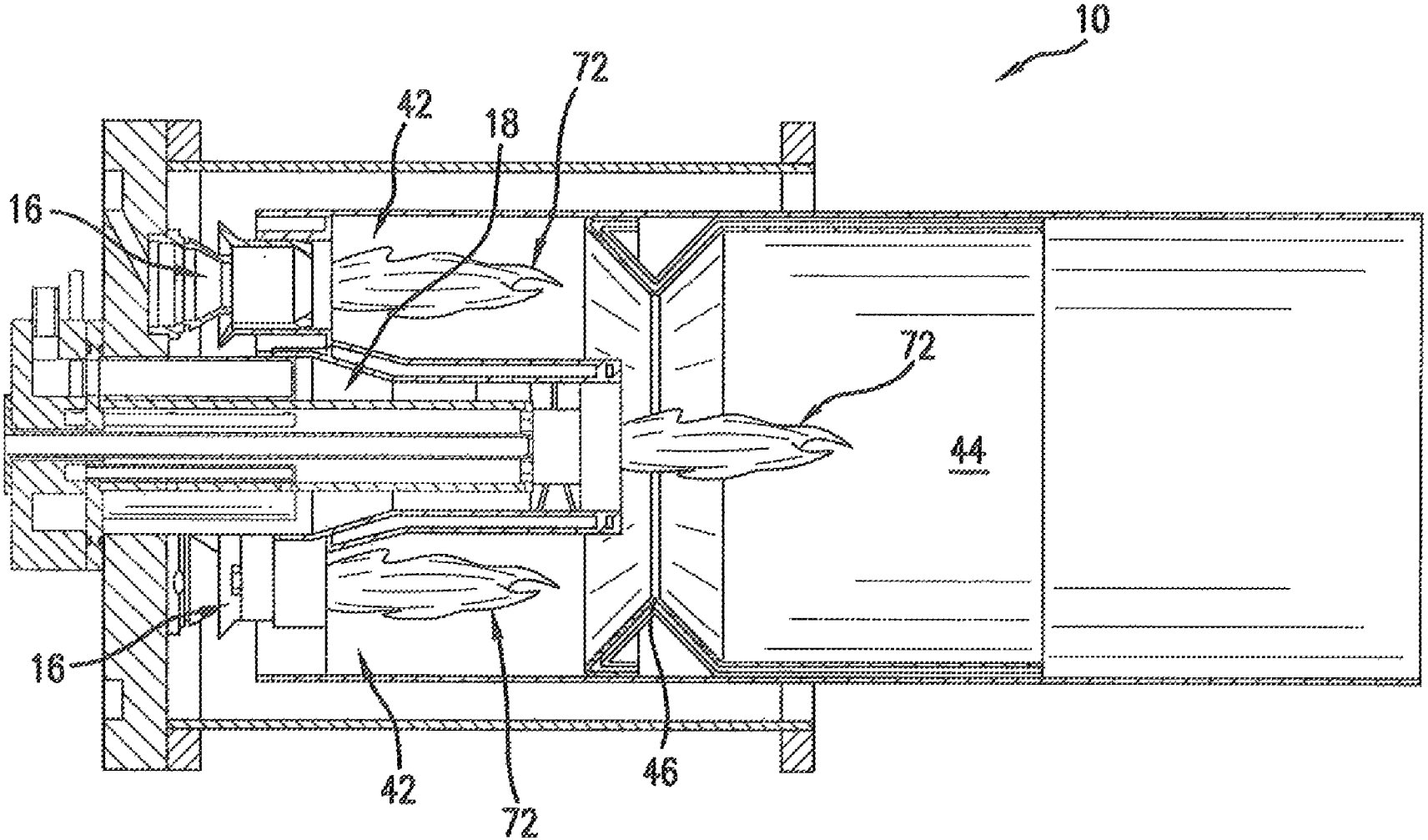
FIG. 9 is a schematic view of the lean-lean operation of an exemplary combustor.

Referring now to FIG. 8, in a typical "primary" operation, flame 72 is first established in primary combustion chamber 42, upstream of secondary combustion chamber 44. The fuel for this initial flame, is provided solely through the primary nozzles 16. In FIG. 9, a flame 72 is established in the secondary combustion chamber 44, while flame 72 also remains in the primary combustion chamber 42. To establish flame 72 in the secondary combustion chamber 44, a portion of the fuel is injected, through the secondary nozzle 18, while a majority of the fuel is sent through the primary nozzles 16. By way of example, 30% of the total fuel discharge is injected through the secondary nozzle while 70% of the fuel is sent through the primary nozzles 16. This flame pattern is indicative of a "lean-lean" type operation.

Figure 10:
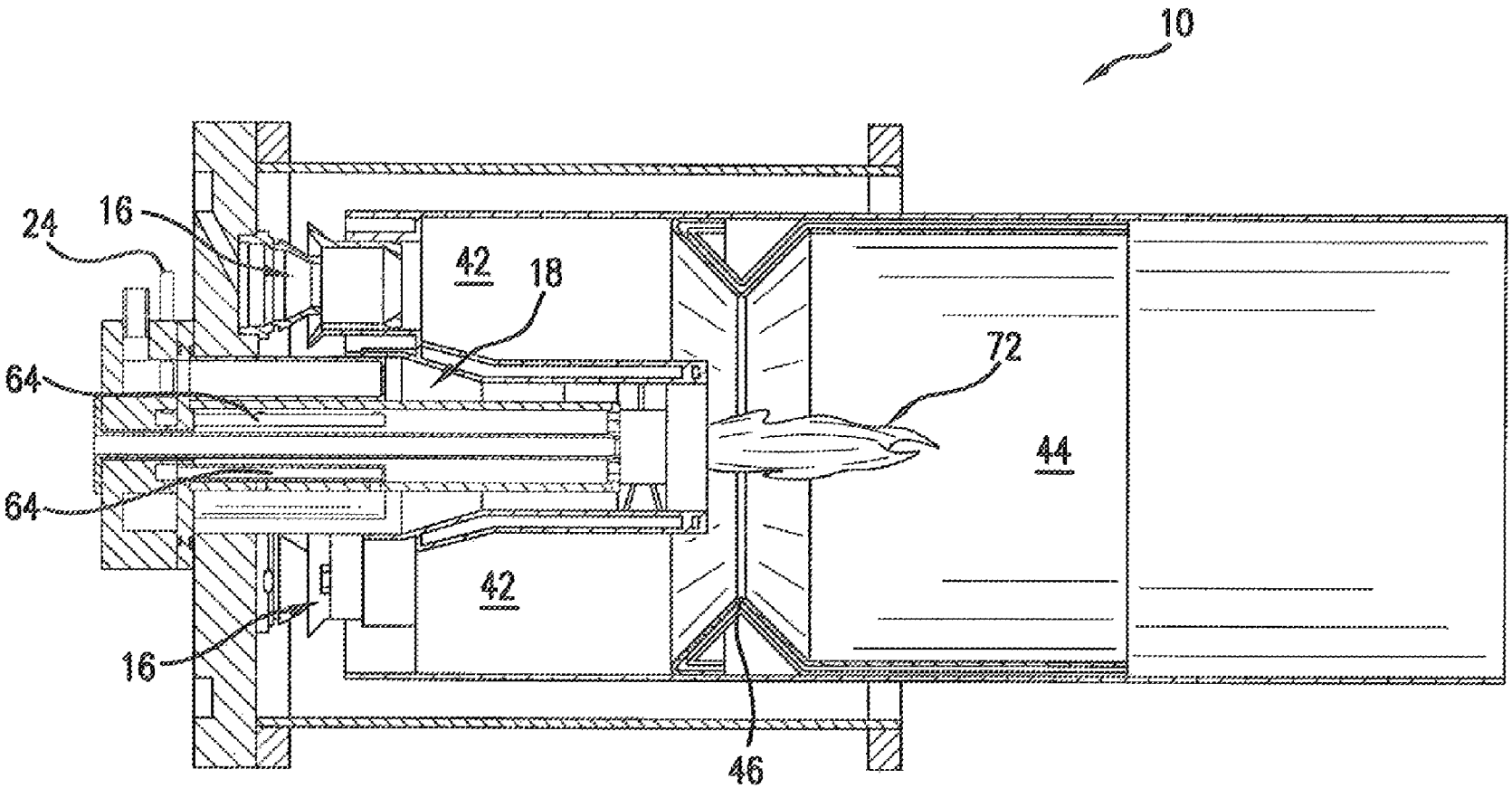
FIG. 10 is a schematic view of the second-stage burning operation of an exemplary combustor.

In FIG. 10, the entire fuel flow is directed through the nozzle body 30 of the secondary nozzle 18, establishing a stable flame within the secondary combustion chamber 44. The flame is extinguished in primary combustion chamber 42 by cutting off fuel flow to the primary nozzles 16. During this "second-stage" burning operation, the fuel that was previously injected through the primary nozzles 16 is diverted to the secondary nozzle 18 through the transfer fuel passages 64. The transfer and premix fuel is injected upstream of the flame 72. The fuel and air flow through the secondary nozzle 18 is considered to be relatively "rich" at this stage because 100% of the fuel flows through the secondary nozzle 18 with only a portion of the air intended for combustion.

Figure 11:
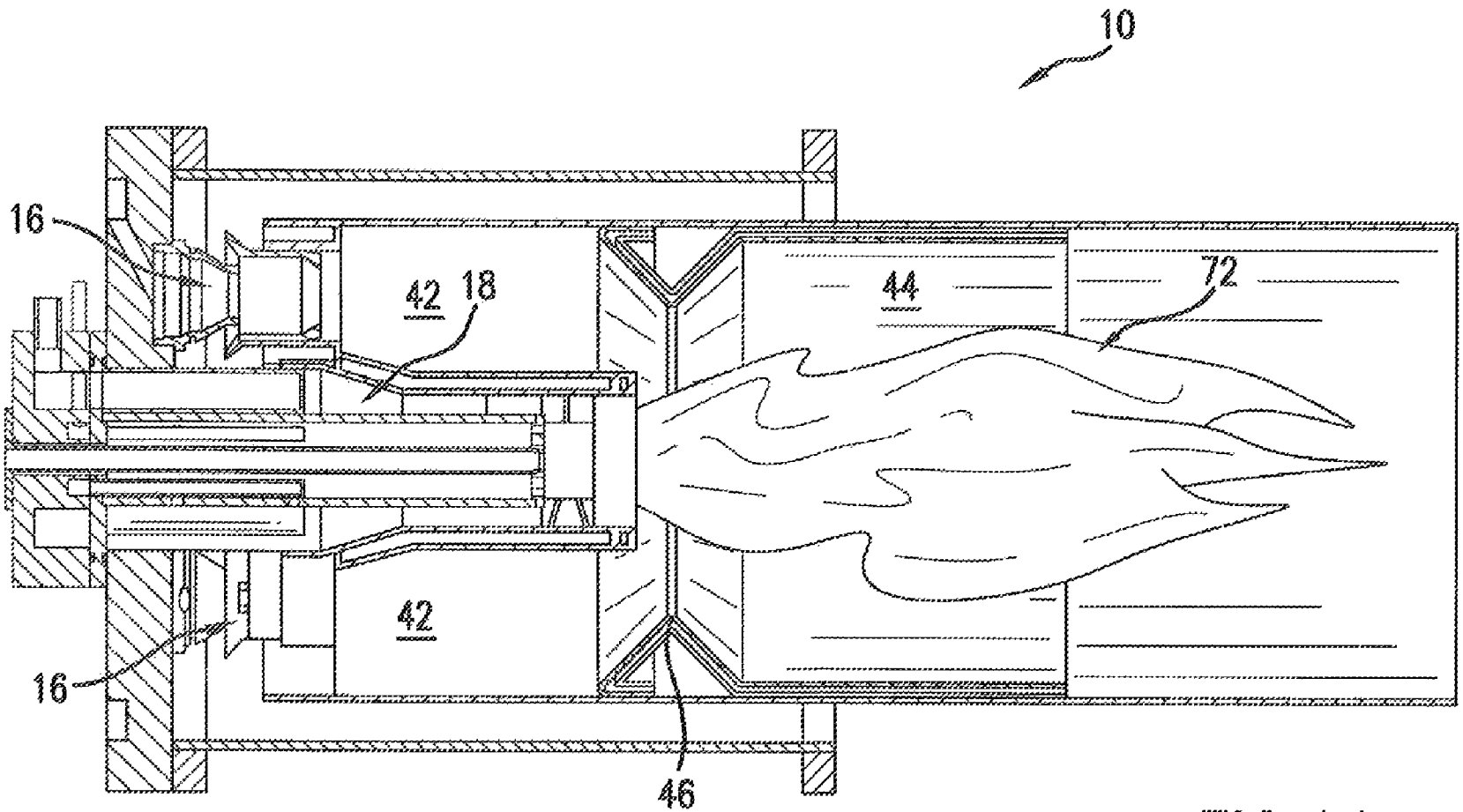
FIG. 11 is a schematic view of the premix operation of an exemplary combustor.

Referring now to FIG. 11, once a stable flame is established in the secondary combustion chamber 44 and the flame is extinguished in the primary combustion chamber 42, fuel flow may be restored to the primary nozzles 16 and the fuel flow to the secondary nozzle 18 is reduced. Because the flame has been extinguished from the primary combustion chamber 42, the primary nozzles 16 act as a premixer. During this "premix" operation mode, the flame is maintained in the secondary combustion chamber 44 as a result of the venturi throat region 46. By way of example, 83% of the total fuel discharge may be sent through the primary nozzles 16, while the remaining 17% of fuel is injected through the secondary nozzle 18. Other relative percentages are also possible.

A variety of modifications to the embodiments described will be apparent to those skilled in the art from the disclosure provided herein. Thus, the invention may be embodied in other specific forms without departing from the spirit or essential attributes thereof and, accordingly, reference should be made to the appended claims, rather than to the foregoing specification, as indicating the scope of the invention.

What is claimed is:

1. A secondary nozzle for a gas turbine comprising:
a flange;
an elongated nozzle body extending from the flange; and
at least one premix fuel injector spaced radially from the nozzle body, the injector extending axially from the flange and generally parallel to the nozzle body for a portion of the length of the nozzle body.

2. The secondary nozzle according to claim 1, wherein the nozzle body has a first length and the premix fuel injector has a second length that is less than the first length.

3. The secondary nozzle according to claim 1, wherein the at least one premix fuel injector comprises a plurality of premix fuel injectors arranged in an annular array around the nozzle body.

4. The secondary nozzle according to claim 3, wherein the secondary nozzle is disposed within a combustor having primary nozzles arranged in an annular array around the secondary nozzle and the premix fuel injectors are disposed between the nozzle body of the secondary nozzle and the primary nozzles.

5. The secondary nozzle according to claim 4, wherein there is an equal number of premix fuel injectors and primary nozzles.

6. The secondary nozzle according to claim 5, wherein each premix fuel injector is disposed between the nozzle body of the secondary nozzle and an adjacent primary nozzle.

7. A turbine combustor comprising:
a secondary nozzle having
a flange;
a fuel source in fluid communication with the flange;
a first nozzle tube extending from the flange and in fluid communication with the fuel source through the flange; and
at least one injector tube, having a proximal end fixed to the flange and extending, independently of the first nozzle tube, axially along a portion of the length of the first nozzle tube, the injector tube fluidly connected to the fuel source through the flange and separate from the connection between the fuel source and the first nozzle tube, and a distal end spaced from the proximal end of the second nozzle.

8. The turbine combustor according to claim 7, wherein the secondary nozzle further comprises at least one third tube extending from the flange and located within the first nozzle tube, the at least one third tube fluidly connected to a fuel source for selectively supplying fuel to the combustor.

9. The turbine combustor according to claim 7, wherein the secondary nozzle is surrounded by an annular configuration of primary nozzles.

10. The turbine combustor according to claim 9, wherein the primary nozzles are radially aligned with a plurality of injector tubes, such that each injector tube is positioned between a primary nozzle and the centrally located first nozzle tube.

11. The turbine combustor according to claim 10, wherein each injector tube has a generally elongated cross section.

12. The turbine combustor according to claim 11, wherein the first end of the elongated cross section of the injector tube is located proximate the first nozzle tube and a second end of the elongated cross section is located proximate a primary nozzle.

13. The turbine combustor according to claim 7, wherein the at least one injector tube comprises a plurality of injector tubes arranged in an annular array around the first nozzle tube.

14. A combustor for a gas turbine comprising:

a fuel source;

a plurality of primary nozzles located in an annular array around the combustor;

a secondary nozzle axially centered between the primary nozzles and having a flange;

an elongated first nozzle tube having a proximal end adjacent the flange and extending into the combustor from the flange, the first nozzle tube being in fluid communication with the fuel source; and at least one premix injector having a proximal end fixed to the flange and extending in a direction generally parallel to the first nozzle tube along a portion of the length of the first nozzle tube, the premix injector radially spaced from the first nozzle tube and fluidly connected to the fuel source through the flange and separate from the connection between the fuel source and the first nozzle tube, and a distal end spaced between the proximal end of the first nozzle tube and the distal end of the first nozzle tube.

15. The combustor according to claim 14, wherein the fuel source comprises at least first and second fuel sources and the primary nozzles are in fluid communication with the first fuel source and at least one of the first nozzle tube or the at least one premix injector is in fluid communication with the second fuel source.

16. The combustor according to claim 14, further comprising a rear wall located adjacent the flange, wherein the primary nozzles extend from the rear wall.

* * * * *